US007517293B1

(12) United States Patent
Smith

(10) Patent No.: US 7,517,293 B1
(45) Date of Patent: Apr. 14, 2009

(54) COMBINATION TENNIS SCORING AND DAMPENING DEVICE

(76) Inventor: Timothy V. Smith, 3215 Evonvale Glenn, Cumming, GA (US) 30041

( * ) Notice: Subject to any disclaimer, the term of this patent is extended or adjusted under 35 U.S.C. 154(b) by 455 days.

(21) Appl. No.: 11/487,756

(22) Filed: Jul. 17, 2006

(51) Int. Cl.
*A63B 49/00* (2006.01)
*A63B 71/06* (2006.01)
*A63B 51/10* (2006.01)

(52) U.S. Cl. ..... 473/522; 273/DIG. 26

(58) Field of Classification Search ..... 473/520–522, 473/553; 273/DIG. 26
See application file for complete search history.

(56) References Cited

U.S. PATENT DOCUMENTS 3,777,699 A 12/1973 Pflger
3,986,715 A 10/1976 Glick
4,189,143 A 2/1980 Van Auken et al.
4,498,668 A 2/1985 Bowen
4,712,504 A 12/1987 Zarley et al.
4,738,449 A * 4/1988 Droz ..... 473/553
4,909,509 A 3/1990 Boschian
5,022,651 A * 6/1991 Barone ..... 473/522
5,048,452 A 9/1991 Haddock et al.
5,489,122 A 2/1996 Pittner
7,012,111 B2 3/2006 Kanemitsu et al.
7,300,366 B1 * 11/2007 Hickey ..... 473/522
7,427,245 B2 * 9/2008 Hickey ..... 473/522
2002/0072438 A1 * 6/2002 Boxer ..... 473/553
2007/0265120 A1 * 11/2007 Hickey ..... 473/520
2008/0076609 A1 * 3/2008 Hickey ..... 473/522

* cited by examiner

*Primary Examiner*—Raleigh W. Chiu
(74) *Attorney, Agent, or Firm*—William B. Noll

(57) ABSTRACT

A multiple component tennis scoring and vibration dampening device including a pair of housing sections that are matable in communication with and attachable to the strings of a tennis racket. Each preferred housing section further includes a rubberized material which functions as a vibration dampening member, and a rotary dial on each of the housing section to designate the score of each player or team.

11 Claims, 5 Drawing Sheets

COMBINATION TENNIS SCORING AND DAMPENING DEVICE

FIELD OF THE INVENTION

This invention is directed to the field of tennis aids, more particularly to a combination score keeping and vibration dampening device for attaching directly to the strings of a tennis racket, and thus readily available to the player for scoring changes while providing dampening properties to the racket.

BACKGROUND OF THE INVENTION

The present invention relates to a device for attachment to the strings of a tennis racket, where the device is a dampening member to control vibrations to the player, which may effect his/her well being, and a score keeper for the player and the opponent.

Dampening devices to help a tennis or other racket player are well known in the respective sports fields. A shockproof device in a tennis racket, for instance, is very important. It prevents the shock waves from transmitting to the handle of a racket in order to protect the hand of a player and to promote the scores of the player in a competition, especially by those weekend players who do not have a professional trainer or coach. In any case, a hit of a tennis racket against a flying ball can create a great deal of shock waves. If the tennis racket has no shockproof arrangement, the shock waves will transmit to the handle of the racket that injure the hand and wrist of the player which could cause 'tennis elbow'. Though some new rackets have such devices on the rackets, they are of limited value. Some recent patent developments illustrating and describing vibration dampening devices may be found in the following U.S. patents:

a.) U.S. Pat. No. 4,909,509, to Boschian, is directed to a device for dampening vibrations in strung rackets, including a first pair of opposed plates and a central body portion which connect the plates. The body portion is receivable in the space defined by two pairs of intersecting racket strings such that the plates grip at least two racket strings. The device further includes a second pair of plates removably attachable to the device, each of the second pair of plates being generally parallel and opposed to one of the plates in the first pair. The device further includes means for removably attaching additional plates such that when the device is mounted on a racket there is a series of parallel, opposed plates extending axially from each side of the racket face. Because the plates may be readily added or removed, and may be of different sizes, the vibration dampening effects of the racket may be tuned to meet a particular player's needs.

b.) U.S. Pat. No. 6,537,164, to Hsu, teaches an elastic sheath damper for the tennis racket throat that includes a racket having a frame, a stringing surface in the frame and a throat separated from a handle to respectively form a truncated triangular configuration and a Y-shaped configuration, each of which has a pair of hollow interior branches made engageable with each other and connected by a pair of cylindrical bars by adhesives. The cylindrical bars have a pair of elastic sheaths respectively sleeved on two ends and inserted into the branches, whereby the shock waves from the frame are absorbed twice by the elastic sheaths in the throat without transmitting to the handle.

c.) U.S. Pat. No. 7,012,111, to Kanemitsu et al., relates to a high specific-gravity EPDM composition, having moldability and weather resistant properties, suitable as a dynamic damper mounted on sports goods, such as a tennis racket.

Personal tennis scoring devices are also well known, and can be helpful aids to the week-end tennis players where scoreboards are neither used nor available. Such devices that are commercially available are typically attached to the racket handle or worn by the player about the wrist. Several examples of tennis scoring devices are taught and illustrated in the following U.S. patents:

d.) U.S. Pat. No. 5,489,122, to Pittner, covers a personal tennis score keeper comprising a strip of sheet material having an upper surface and a lower surface and with the upper surface thereof bearing squares arranged in a linear array and forming three columns, one of the columns bearing indicia indicating the number of games won by a player, another column bearing indicia indicating the number of games won by an opposing player, and the remaining column bearing indicia for indicating a score of each player during a game; and a plurality of scoring markers slidably secured to the strip in a juxtaposed slidable relation with respect to a column for marking a score.

e.) U.S. Pat. No. 5,048,452, to Haddock et al., is directed to a scoring device for use in racket games. A track member is mounted to a base member by an attachment means which allows relative movement between the base and track members. Scoring indicators move along the track member. An adhesive label is attached to the base member to allow its attachment to a curved surface and more particularly to the curved surface such that of a throat of a racket.

f.) U.S. Pat. No. 4,712,504, to Zarley et al., teaches a tennis scoring device comprising an elongated body member having a longitudinal axis, with a visible tennis scoring indicia secured on the top surface of the body member and extending along the longitudinal axis thereof. The indicia strip is divided into a plurality of duplicate scoring segments representing the scores of the player and the opponent. A pair of slide members are resiliently slidably mounted on the edges of the body member and extend over the indicia strip. An apertures in each of the slide members provides visible access to a given indicia segment. The width of the body member is greater than the normal width of the slide members so that the slide members are slightly expanded upon being mounted on the body member to resiliently hold the slide members in position on the body member.

g.) U.S. Pat. No. 4,498,668, relates to a device for scoring the opposing sides of a tennis match which is adapted to be mounted on the side of a tennis racket handle. A vibration of this device may be employed to keep count of the games won by each side. The device comprises an elongated, flexible, transparent structure which is segmented into two compartments by a seam across its mid section. Enclosed within each compartment is a bead-like chip or marker which is slideably movable therein when the marker is pressed gently. Each chip is held in place by a spring-like action wedging it against the wall of its compartment and preventing it from being moved inadvertently during the game. The structure itself is sandwiched between two strips of film which are adhesively attached together. The outer film layer includes an elongated transparent panel through which each marker may be viewed within its compartment and upon which are imprinted indicia, each of which corresponds to a score in a tennis game. The markers are movable to positions beneath these indicia, which represent the tennis scoring points "love" to "15", "30" and "40". When a marker is slid beneath a particular indicia, that marking stands out from its background so that the score can be easily read. Otherwise, the indicia above each compartment and the layer of film disposed beneath it are difficult to distinguish visually from each other.

h.) U.S. Pat. No. 4,189,143, to Van Auken et al., covers a tennis scorekeeping device having a pair of separately formed scorekeeping units adapted to be mounted one each side of a tennis racket handle between the head of the racket and the handle grip of the racket, first manually manipulatable means on one of said units for scoring game points won by opposing players, and second manually manipulatable means on the other of said units for scoring the games won by opposing players.

i.) U.S. Pat. No. 3,986,715, to Glick, is directed to a scoring device capable of being mounted on the handle of a tennis racket with a pair of padlike members, having a series of parallel grooves, which are adhesively mounted to opposite sides of the handle of the racket, the grooves extending in a direction normal to the longitudinal axis of the handle. A resilient band having a pair of beads at diametrically opposed positions on the band is stretched around the handle, the beads being conformed to be seated in one of the recesses of the respective pad members of the handle.

It is apparent from both commercially known products, and those devices of the foregoing prior art that various tennis aids are available to tennis players, but none teach or suggest a convenient and readily usable combination device that offers both scoring and dampening capabilities, particularly as found in the device of the present invention. The manner by which this invention brings together these capabilities will become more apparent from the following specification, especially when read in conjunction with the accompanying drawings.

SUMMARY OF THE INVENTION

This invention teaches a personal tennis scoring and vibration dampening device for attachment to the bed of strings of a tennis racket. The preferred device comprises a pair of generally circular housing members, where said members are matable and attachable through the bed of strings. The respective members have a top wall and a discontinuous wall, i.e. distinct arcuate wall segments, extending therefrom, where the spaces between the wall segments allow said members to override the strings and thus mate. Further, each housing section includes a rubberized material to provide the vibration dampening qualities to the device. Additionally, the outer face of the top wall of each member bears indicia of the tennis scoring system, i.e. 'L', or a symbol to represent zero, '15', '30', '40', and 'AD', and includes means to mount a rotating face plate that features a window to allow the player to rotate said face plate to the indicated score at any time during the tennis match.

Accordingly, a feature of this invention is the provision of a convenient and readily usable tennis scoring and dampening device that is directly attached to the bed of strings of a tennis racket.

Another feature hereof lies in the use of a pair of matable housing sections, where the sections override the strings in mating engagement.

Still a further feature of the invention is the provision of positioning a pair of rubberized members in the respective housing members to provide the vibration dampening qualities to the device.

These and other features of the invention will become clearer in the description and drawings which follow.

DETAILED DESCRIPTION OF PREFERRED EMBODIMENT

Figure 1:
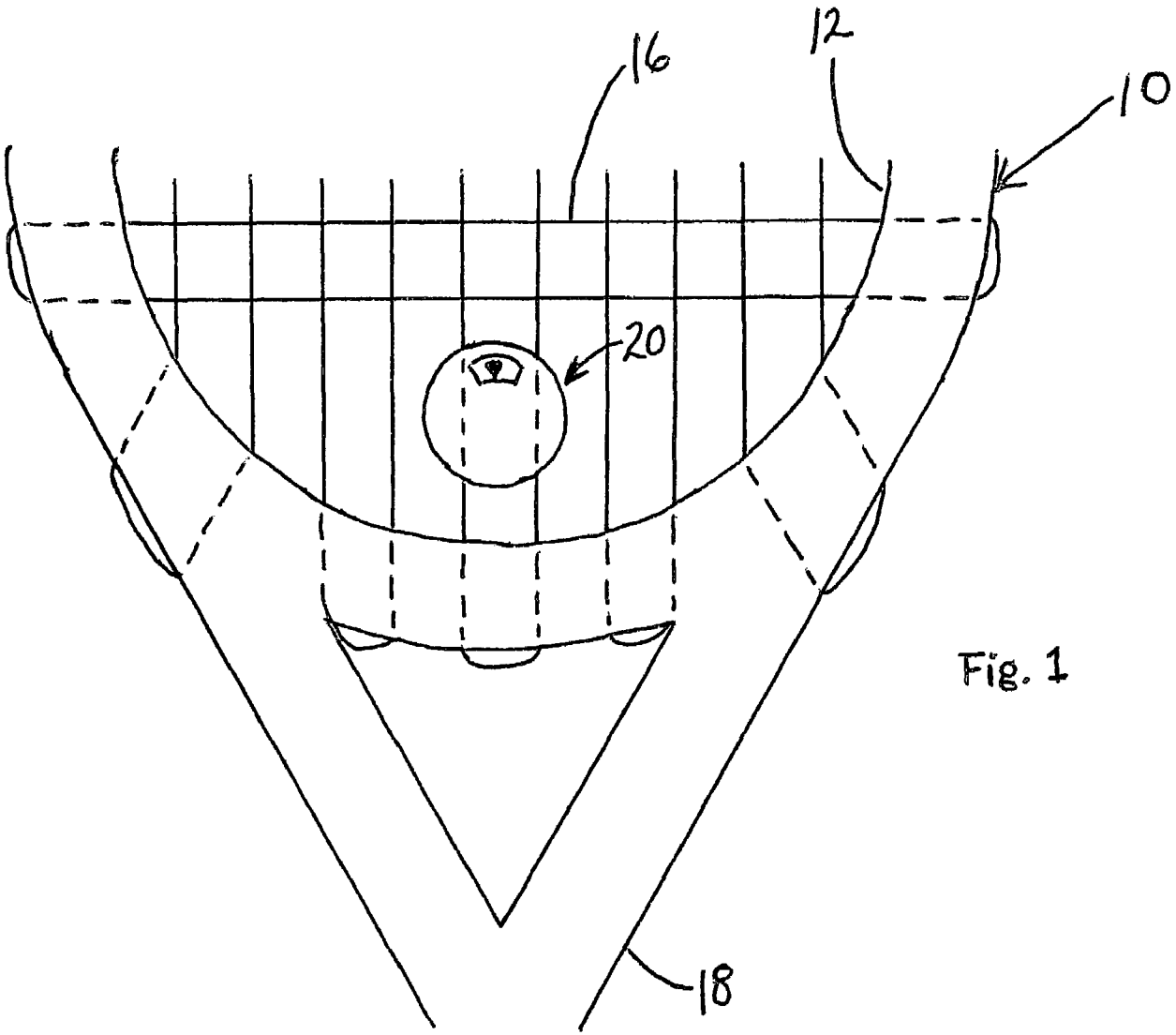
FIG. 1 is a partial plan view of a tennis racket, characterized by a generally oval shaped frame portion having a bed of horizontally and vertically oriented interwoven strings, a handle terminating in a throat section, mounting the tennis scoring and dampening device of this invention.

The present invention is directed to a tennis scoring and vibration dampening device for attaching to the bed of the strings of a tennis racket, preferably in proximity to the throat of the racket. The unique and convenient device will now be described with regard to the accompanying drawings, where like reference numeral represent like components or features throughout the several views.

Turning first to FIG. 1 for help in understanding the invention, there is illustrated at least a portion of a tennis racket, as known in the art. The tennis racket comprises a frame 10 having a generally oval shaped opening 12 containing a bed of strings 16 composed of a series of horizontal and interwoven vertical strings. Extending downwardly from the oval shaped opening 12 is the throat 18 and terminating in a handle gripped by the player. Shown mounted on the bed of strings 16, in proximity to the throat 18, is the preferred tennis scoring and vibration dampening device 20 of the invention.

Figure 2:
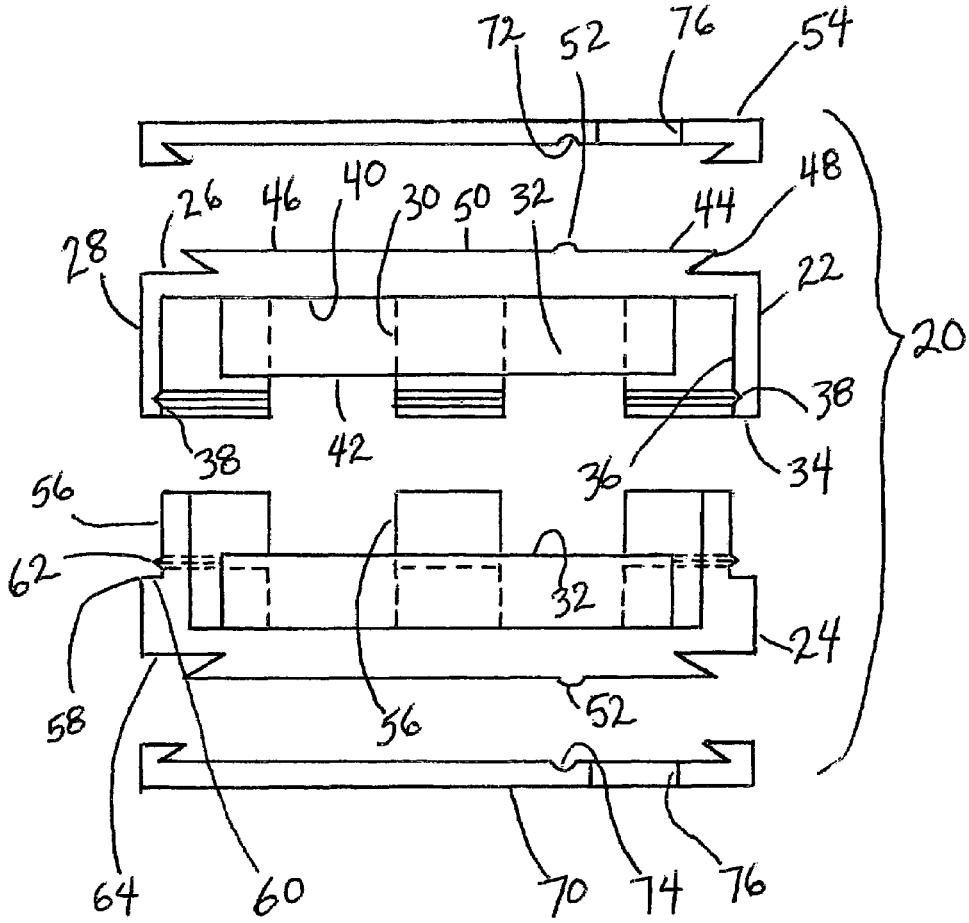
FIG. 2 is an exploded sectional view showing the various preferred components comprising the matable device of the invention.
Figure 3:
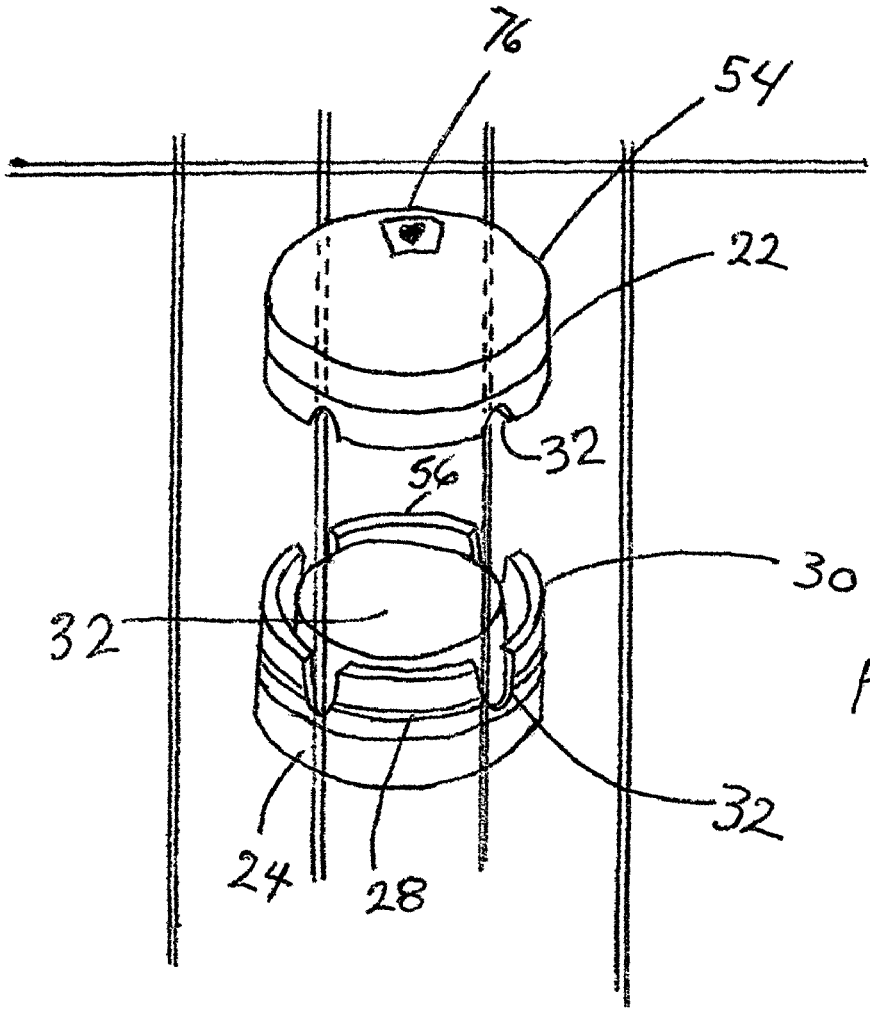
FIG. 3 is an exploded perspective view showing the preferred manner of securing the mated device to the tennis strings.

FIGS. 2 and 3 illustrate detail of a preferred construction of the device 20. The device comprises a pair of intermatable housing members 22, 24, where a first said housing member 22 is characterized by a top wall 26 having a downwardly extending, discontinuous wall 28. While a generally circular wall is the preferred configuration, other geometrical shapes, such as rectangular, may be used. Notwithstanding, the further discussion will be directed to the preferred shape. The discontinuous wall 28, as best seen in FIG. 3, comprises plural arcuate segments 30 spaced apart by slots 32 or spaces to accommodate the strings of the tennis racket. Further, the discontinuous wall 28, or wall segments 30, terminate in a free end 34, where the inner wall surface 36 includes an annular slot 38, in proximity to the free end 34, the function of which will be apparent hereinafter. Mounted to the inside surface 40 of the top wall 26 is a rubberized material 42 that provides vibration dampening properties to the device.

Figure 5:
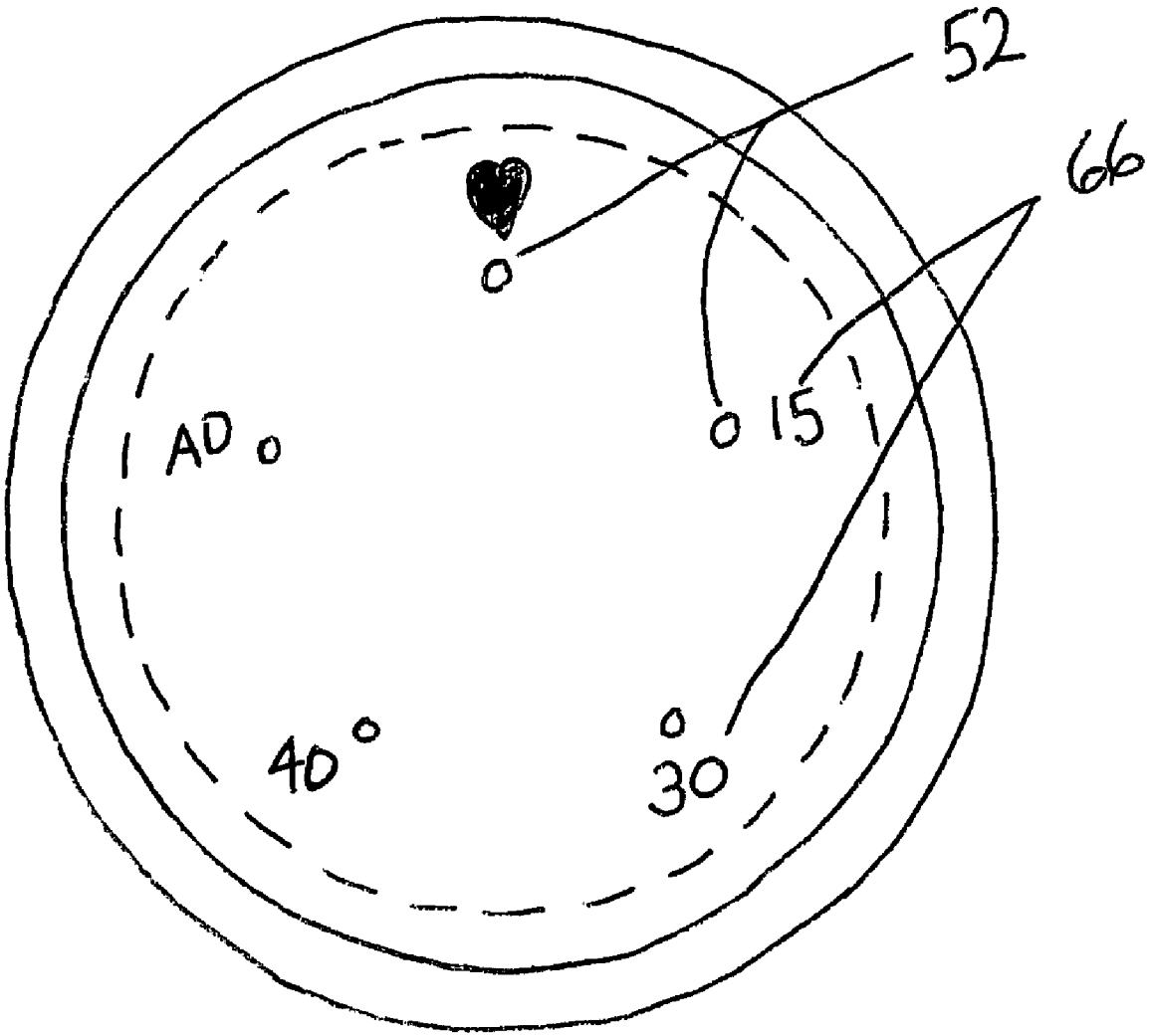
FIG. 5 is a plan view of the outer upper surface of one of the matable housing sections showing indicia indicating the scores of a particular player.

The upper surface 44 of the top wall 26 mounts a rotary dial that conveniently shows the score of the tennis match. In a preferred embodiment, the upper surface 44 includes a circular raised section 46 that features a peripheral rib or edge 48, where the edge is recessed inwardly from the discontinuous wall 28. Along the planar surface 50 of the raised section 46 an array of score indicia, see FIG. 5, are provided. Additionally, the planar surface may include plural dimples or projections 52 that cooperate with the cover member 54 as later discussed.

The second said housing member 24 is similarly constructed to the first said housing member 22. However, the discontinuous wall 56 is recessed inwardly to effect the mating of the respective housing members 22, 24, see in particular FIG. 2. Near the base 58 of the recessed wall section 60 is an outwardly extending annular rib 62 for interlocking with the annular slot 38 in a mating relationship. The top wall 64 is complementary constructed to that of the first said housing section. It is understood that other securing or clamping means for the respective housings may be used from that described above.

Figure 4:
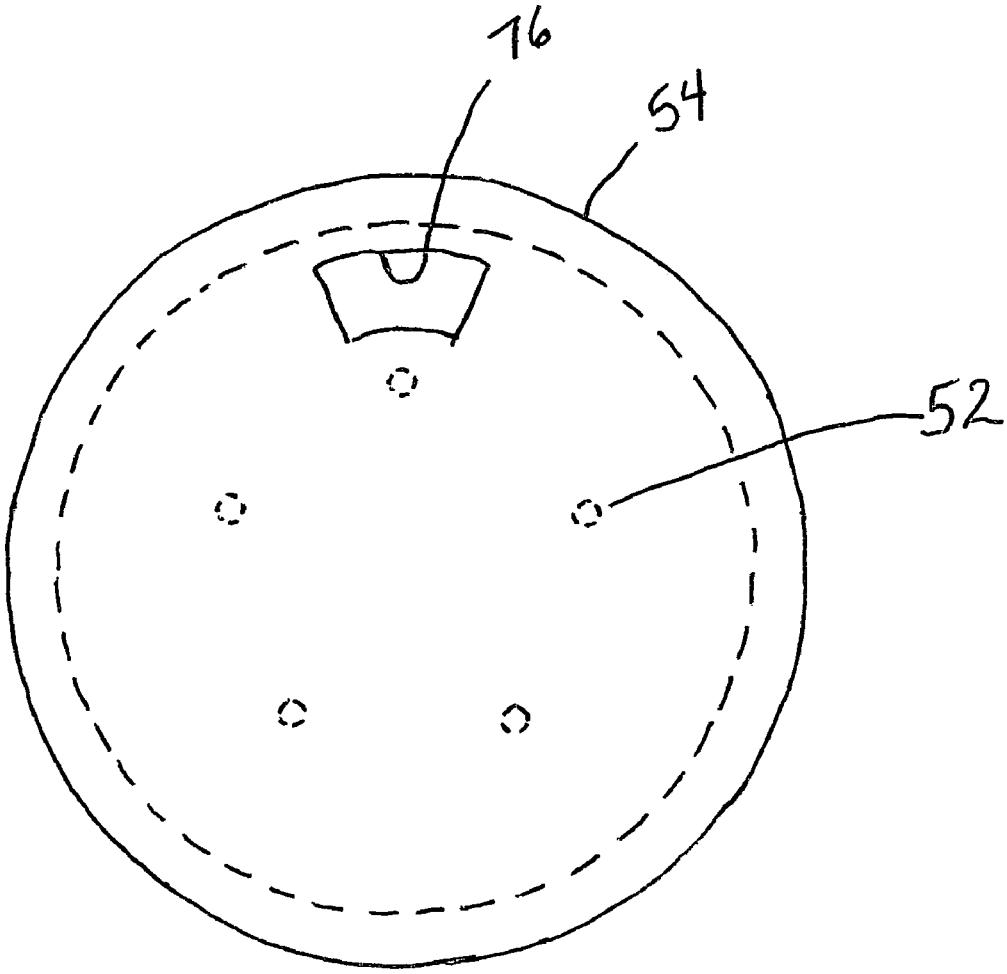
FIG. 4 is a top view of the dial plate/face overriding the device hereof to reveal a player's score at any given time during the tennis match.

FIGS. 4 and 5 illustrate additional details of the rotary scoring dial, one on each of the outer or top walls 26, 64, where the upper raised surfaces bear scoring indicia 66, such as illustrated in FIG. 5. Specifically, such indicia includes an array of spaced apart designations, such as 'L', a heart of zero to indicate "Love", and numerical designations '15', '30', and '40' along with 'AD' to designate 'Advantage'. As known in the art, if the player holding the advantage loses the point, the score would go back to 40-40, or deuce. In any case, each player or teams' score can be keep and viewed at any time. To ensure which score is being designated, the rotary cover members 54, 70 is mounted for movement about the respective fixed housing members 22, 24. As best seen in section in FIG. 2, the under surface of the cover members 54, 70 is provided with a recess 72, 74 complementary sized to slidably and temporarily receive the projections 52. That is, as the rotary cover is rotated, the projections 52 move into a selected said recess, until again rotated with the changing score. Note in FIG. 5 that there is a single projection assigned to each said score designation. To view the designated score, the respective rotary cover members 54, 70 are provided with a window 76 to overlie the designated score. While a pair of rotary dials, one on each side of the housings are preferred, it will again be understood that they may be on the same side, and that the scoring readout may be an electrical digital readout device, where such devices are known in the art.

It is recognized that change, variations or modifications may be made to the tennis scoring and vibration dampening device of this invention without departing from the spirit and scope thereof. Accordingly, no limitation is intended to be imposed thereon except as set forth in the accompanying claims.

I claim:

1. A combination tennis scoring and vibration dampening device for directly securing to the bed of strings of a tennis racket, said racket having a frame portion containing a bed of strings formed by plural horizontally and vertically oriented, interwoven strings, a handle with a throat portion adjacent said frame portion, said device comprising:

a pair of intermatable housing sections for mating through said strings in proximity to said throat portion;

a.) a first said section having a top wall with outer and inner surfaces, and a downwardly extending discontinuous wall from said top wall and terminating in a free end, said inner surface mounting a rubberized material functioning as a vibration dampening member, said downwardly extending discontinuous wall having means in proximity to said free end for mating with a complementary means on said second section;

b.) a second said section having a top wall with outer and inner surfaces, and a downwardly extending discontinuous wall from said top wall and terminating in a free end, said inner surface mounting a rubberized material functioning as a vibration dampening member, said downwardly extending discontinuous wall having means remote to said free end for engaging said means on said first said section; and, c.) at least one said section along its said outer surface having a scoring mechanism to identify the score of a player.

2. The combination tennis scoring and vibration dampening device according to claim 1, wherein said first and section sections are generally circular in configuration, where one said section contains an annular groove in proximity to said free end for mating with a complementary rib on said second section.

3. The combination tennis scoring and vibration dampening device according to claim 2, wherein at least one said section along its said outer surface includes at least one rotary scoring mechanism having visual means identifying the tennis score.

4. The combination tennis scoring and vibration dampening device according to claim 3, wherein each said outer surface includes a separate scoring mechanism.

5. The combination tennis scoring and vibration dampening device according to claim 4, wherein said outer surfaces mount a rotary cover having a window therein to allow viewing of a selected tennis score.

6. The combination tennis scoring and vibration dampening device according to claim 1, wherein said upper surfaces have a raised central portion characterized by an annular flange, and said attaching covers have inwardly directed grooves for snap engaging with a respective said raised central portion and rotatable thereto.

7. The combination tennis scoring and vibration dampening device according to claim 6, wherein said upper surfaces each include a circular array of raised projections, and said rotating covers include at least one recess for incrementally engaging a said raised projection.

8. The combination tennis scoring and vibration dampening device according to claim 7, wherein there are five uniformly arranged said projections, each said projection positioned adjacent a said scoring indicia.

9. The combination tennis scoring and vibration dampening device according to claim 1, wherein said respective section discontinuous walls each comprise four sections.

10. The combination tennis scoring and vibration dampening device according to claim 1, wherein each said section is circular in configuration.

11. The combination tennis scoring and vibration dampening device according to claim 9, wherein said discontinuous wall is characterized by plural spaced apart arcuate sections, where the spacings overlie the tennis strings in an assembled and mating position.

* * * * *